US009713754B2

(12) United States Patent
Herron et al.

(10) Patent No.: US 9,713,754 B2
(45) **Date of Patent: *Jul. 25, 2017**

(54) LIGHTWEIGHT MODULAR GOLF BAG WITH FRAME

(71) Applicant: NIKE, Inc., Beaverton, OR (US)

(72) Inventors: Heather L. Herron, Portland, OR (US); Pierre A. Pactanac, Portland, OR (US); Michael Wallans, Portland, OR (US); Jeffrey W. Wear, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

This patent is subject to a terminal disclaimer.

(21) Appl. No.: 14/475,342

(22) Filed: Sep. 2, 2014

(65) Prior Publication Data

US 2015/0083618 A1 Mar. 26, 2015

Related U.S. Application Data

(63) Continuation of application No. 13/484,806, filed on May 31, 2012, now Pat. No. 8,820,524, which is a (Continued)

(51) Int. Cl.
*A63B 55/00* (2015.01)
*A63B 55/20* (2015.01)

(52) U.S. Cl.
CPC ..... *A63B 55/008* (2013.01); *A63B 55/00* (2013.01); *A63B 55/20* (2015.10); *A63B 55/408* (2015.10); *A63B 2225/68* (2013.01)

(58) Field of Classification Search
CPC ..... A63B 55/008; A63B 55/20; A63B 55/408; A63B 55/00; A63B 2225/68
See application file for complete search history.

(56) References Cited

U.S. PATENT DOCUMENTS 1,254,640 A 1/1918 Stevenson
1,409,323 A 3/1922 Welts (Continued)

FOREIGN PATENT DOCUMENTS

CN 2410004 Y 12/2002
CN 2526042 Y 12/2002

(Continued)

OTHER PUBLICATIONS

International Search Report and Written Opinion dated Jan. 7, 2013 in Application No. PCT/US2012/060025, 11 pages.

(Continued)

*Primary Examiner* — Tri Mai
(74) *Attorney, Agent, or Firm* — Honigman Miller Schwartz and Cohn LLP; Matthew H. Szalach; Jonathan P. O'Brien

(57) ABSTRACT

A modular golf bag having an external frame is provided. Poles connect a frame top capable of receiving golf clubs to a frame bottom. A pliable bag body extends between the frame top and the frame bottom such that a cavity capable of receiving golf clubs through the frame top is formed. Poles may be affixed to the pliable bag body using internally positioned pole sleeves, one or more slits in the pliable bag body, or a combination thereof. Also, storage compartments may be detachably connected between the poles.

15 Claims, 10 Drawing Sheets

Related U.S. Application Data continuation-in-part of application No. 13/273,651, filed on Oct. 14, 2011, now Pat. No. 9,205,313.

(56) References Cited

U.S. PATENT DOCUMENTS

| | | | | |
|---|---|---|---|---|
| 1,444,357 | A | | 2/1923 | Madison |
| 1,498,910 | A | | 6/1924 | Harpham |
| 1,899,825 | A | | 2/1933 | Reach |
| 2,070,254 | A | | 2/1937 | Burgner |
| 2,507,249 | A | | 5/1950 | Nick |
| 2,791,255 | A | | 5/1957 | Ogden |
| 2,799,315 | A | | 7/1957 | Strasburg |
| 2,902,287 | A | | 9/1959 | Elias |
| 3,147,786 | A | | 9/1964 | Kish, Jr. |
| 3,860,157 | A | | 1/1975 | Richards et al. |
| 3,912,138 | A | | 10/1975 | Pava et al. |
| 3,938,718 | A | | 2/1976 | Madison |
| 4,099,657 | A | | 7/1978 | Zufich |
| 4,248,367 | A | | 2/1981 | Buel |
| 4,249,586 | A | | 2/1981 | Setani |
| 4,266,589 | A | | 5/1981 | Cochran |
| 4,350,194 | A | | 9/1982 | Brown |
| 4,378,039 | A | | 3/1983 | Suk |
| 4,438,876 | A | | 3/1984 | Ward |
| 4,448,305 | A | | 5/1984 | Sup |
| 4,466,659 | A | | 8/1984 | Carpentier et al. |
| 4,673,070 | A | | 6/1987 | Ambal |
| D296,092 | S | | 6/1988 | Dzeskewicz |
| 4,796,752 | A | | 1/1989 | Reimers |
| 4,895,198 | A | | 1/1990 | Samuelson |
| 5,038,984 | A | | 8/1991 | Izzo |
| 5,222,598 | A | | 6/1993 | Yamazoe |
| 5,314,063 | A | | 5/1994 | Lee |
| 5,465,839 | A | | 11/1995 | Gretz |
| 5,482,160 | A | | 1/1996 | Perrin |
| 5,632,071 | A | | 5/1997 | Maunder |
| 5,632,496 | A | | 5/1997 | Nelson |
| 5,704,530 | A | * | 1/1998 | Scherer ..... A45F 3/08 224/632 |
| 5,769,220 | A | | 6/1998 | Hong |
| 5,873,504 | A | * | 2/1999 | Farmer ..... A45C 3/00 150/113 |
| 5,941,383 | A | | 8/1999 | Cheng |
| 5,956,766 | A | * | 9/1999 | Benway ..... B62B 9/10 2/69 |
| 6,024,265 | A | | 2/2000 | Clements |
| 6,227,503 | B1 | | 5/2001 | Chen |
| 6,330,944 | B1 | | 12/2001 | DeMichele |
| 6,415,919 | B1 | | 7/2002 | Keller |
| 6,478,151 | B1 | | 11/2002 | Schmidt et al. |
| 6,637,590 | B1 | | 10/2003 | Matsuki |
| 6,651,853 | B2 | | 11/2003 | Higgins et al. |
| 6,736,264 | B2 | | 5/2004 | Yoshida |
| 6,994,050 | B2 | | 2/2006 | Johnson et al. |
| 7,650,990 | B2 | | 1/2010 | Tan |
| 7,780,002 | B2 | | 8/2010 | Manaster et al. |
| 2003/0094390 | A1 | | 5/2003 | Thompson et al. |
| 2003/0168362 | A1 | | 9/2003 | Yoshida |
| 2004/0108350 | A1 | | 6/2004 | Warren |
| 2005/0072695 | A1 | | 4/2005 | Shaanan |
| 2008/0006548 | A1 | | 1/2008 | Shiao |
| 2010/0051489 | A1 | | 3/2010 | Shiao |
| 2011/0073504 | A1 | | 3/2011 | Aubery et al. |
| 2011/0162985 | A1 | | 7/2011 | Shiao |

FOREIGN PATENT DOCUMENTS

| | | | |
|---|---|---|---|
| CN | 201537363 | U | 8/2010 |
| JP | 2001198250 | A | 7/2001 |
| JP | 2003052877 | A | 2/2003 |
| JP | 3099351 | U | 4/2004 |
| JP | 2007075296 | A | 3/2007 |
| WO | 2003061776 | A1 | 7/2003 |

OTHER PUBLICATIONS

International Search Report and Written Opinion dated Jan. 22, 2013 in Application No. PCT/US2012/060028, 11 pages.
Non-Final Office Action dated Aug. 6, 2013 in U.S. Appl. No. 13/484,806, 11 pages.
Notice of Allowance dated Apr. 24, 2014 in U.S. Appl. No. 13/484,806, 9 pages.
Non-Final Office Action dated Jul. 11, 2014 in U.S. Appl. No. 13/273,651, 7 pages.
European Search Report dated Mar. 10, 2015 in Application No. 12840485.2, 7 pages.
European Search Report dated Mar. 10, 2015 in Application No. 12840048.8, 7 pages.
Final Office Action dated Nov. 12, 2014 in U.S. Appl. No. 13/273,651, 5 pages.
Non-Final Office Action dated Mar. 16, 2015 in U.S. Appl. No. 13/273,651, 6 pages.
Notice of Allowance dated Jul. 20, 2015 in U.S. Appl. No. 13/273,651, 10 pages.
State Intellectual Property Office, Chinese Office Action for Application No. 201280043121.3, mailed Sep. 22, 2015.
Japan Patent Office, Japanese Office Action for Application No. 2014-535941 mailed Jul. 26, 2016.
State Intellectual Property Office, Chinese Office Action for Application No. 201280043121.3, mailed Oct. 28, 2016.
State Intellectual Property Office, Chinese Office Action for Application No. 201280022397.3, mailed Oct. 9, 2015.
Japan Patent Office, Japanese Office Action for Application No. 2014-535940 mailed Jun. 21, 2016.

* cited by examiner

LIGHTWEIGHT MODULAR GOLF BAG WITH FRAME

CROSS-REFERENCE TO RELATED APPLICATIONS

This application is a continuation of U.S. application Ser. No. 13/484,806, filed May 31, 2012 and entitled "LIGHTWEIGHT MODULAR GOLF BAG WITH FRAME" which is a continuation-in-part of prior U.S. application Ser. No. 13/273,651, filed on Oct. 14, 2011 and entitled "LIGHTWEIGHT MODULAR GOLF BAG HAVING EXTERNAL FRAME."

STATEMENT REGARDING FEDERALLY SPONSORED RESEARCH OR DEVELOPMENT

Not applicable.

TECHNICAL FIELD

The present invention relates to golf bags. More particularly, the present invention relates to lightweight golf bags having an external frame and modular storage compartments that can be attached to the external frame in a variety of configurations.

BACKGROUND

Golf bags have long been an essential part of the game of golf due to the difficulty of carrying the number of clubs required to play properly. Conventionally, a golf bag is designed with a main compartment for holding golf clubs and a variety of accessory compartments for holding items such as golf balls, tees, towels, etc. Conventional golf bags are also made of robust materials that make the bag somewhat heavy. Carrying a heavy bag can fatigue a golfer and adversely affect the golfer's performance. Additionally, accessory compartments not being used by a golfer remain part of the bag and must be carried, adding additional weight to an already heavy bag. A golfer may also wish for a different selection of compartments but is limited by the compartments selected by the manufacturer.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present invention includes a modular golf bag having an internal or external frame. A frame top is capable of receiving golf clubs. A frame bottom is located approximately the length of a golf club below the frame top. A plurality of poles connect the frame top and the frame bottom. A pliable bag body internal or external to the plurality of poles extends between the frame top and the frame bottom such that a cavity capable of receiving golf clubs through the frame top is formed. A plurality of pole sleeves may be internally or externally attached to the pliable bag body in one embodiment. In such an embodiment, each of the plurality of pole sleeves surrounds at least a portion of the length of one of the plurality of poles such that each of the plurality of poles runs through at least one pole sleeve. The plurality of pole sleeves provide structure to the pliable bag body by internally or externally securing the pliable bag body to the plurality of poles.

Another aspect of the present invention includes a modular golf bag having an internal frame created by poles being inserted into or exiting various slits in a pliable bag body of the bag. A frame top is capable of receiving golf clubs, a frame bottom is located approximately the length of a golf club below the frame top, and a plurality of poles connect the frame top and the frame bottom. A pliable bag body external to the plurality of poles extends between the frame top and the frame bottom such that a cavity capable of receiving golf clubs through the frame top is formed. Slits in the pliable bag body provide areas for the poles to enter and exit the cavity, thereby creating the internal frame of the golf bag. The slits may be reinforced in various manners to create durable openings that will protect against various wear and tear.

Additionally, one or more storage compartment may be detachably connected between at least two of the plurality of poles. The compartments may be directly connected to external poles, connected to internal poles exposed at openings or slits, or connected to non-exposed internal poles around the surrounding pliable bag body.

BRIEF DESCRIPTION OF THE DRAWINGS

The present invention is described in detail below with reference to the attached drawing figures, wherein.

DETAILED DESCRIPTION

Conventional golf bags are heavy, and the storage compartments of conventional golf bags are not configurable. The present invention provides modular golf bags that are lightweight and have either an external or internal frame. Modular additional storage compartments can be detachably connected to the external or internal frame in a variety of configurations. The compartments may be directly connected to external poles, connected to internal poles exposed at openings or slits, connected to non-exposed internal poles around the surrounding pliable bag body, or a combination thereof. Examples of the present invention are illustrated in FIGS. 1-10.

Figure 1:
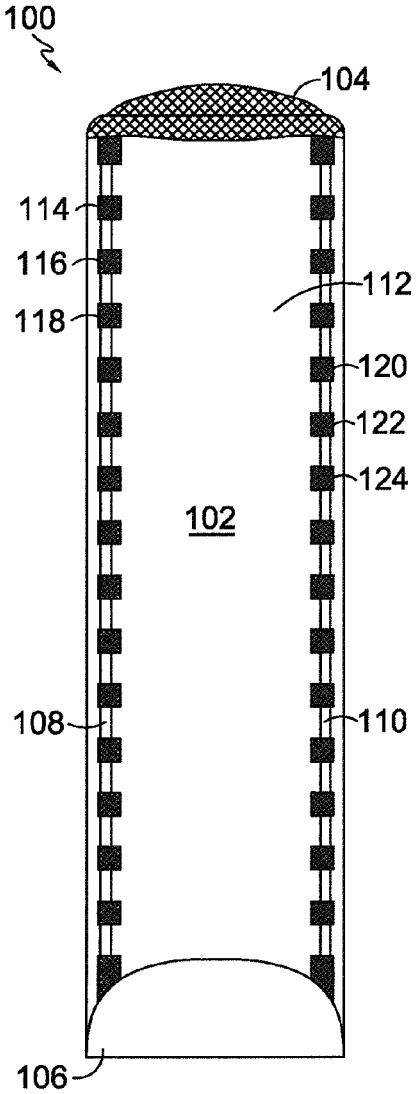
FIG. 1 is a back perspective view of a modular golf bag in accordance with an example of the present invention, the golf bag having a large number of external pole sleeves spaced along the length of each pole.

FIG. 1 illustrates front side 102 of modular golf bag 100. Frame top 104 is capable of receiving golf clubs. In some examples frame top 104 is open. In other examples, frame top 104 includes a rim and zippered covering. Frame bottom 106 is located approximately the length of a golf club below frame top 104. A plurality of poles 108 and 110 connect frame top 104 and frame bottom 106. Pliable bag body 112 is internal to poles 108 and 110. Pliable bag body 112 extends between frame top 104 and frame bottom 106 such that a cavity (not shown) capable of receiving golf clubs through frame top 104 is formed.

A plurality of pole sleeves 114, 116, 118, 120, 122, and 124 are attached to the pliable bag body. Each of pole sleeves 114, 116, and 118 surround at least a portion of the length of pole 108. Similarly, each of pole sleeves 120, 122, and 124 surround at least a portion of the length of pole 110. Each of poles 108 and 110 runs through at least one pole sleeve. Pole sleeves 114, 116, 118, 120, 122, and 124 provide structure to pliable bag body 112 by securing pliable bag body 112 to poles 108 and 110 in an extended position. Only pole sleeves 114, 116, 118, 120, 122, and 124 are numbered in FIG. 1 for clarity, but it is to be appreciated that FIG. 1 illustrates pole sleeves spaced across substantially the entire length of poles 108 and 110.

Figure 2:
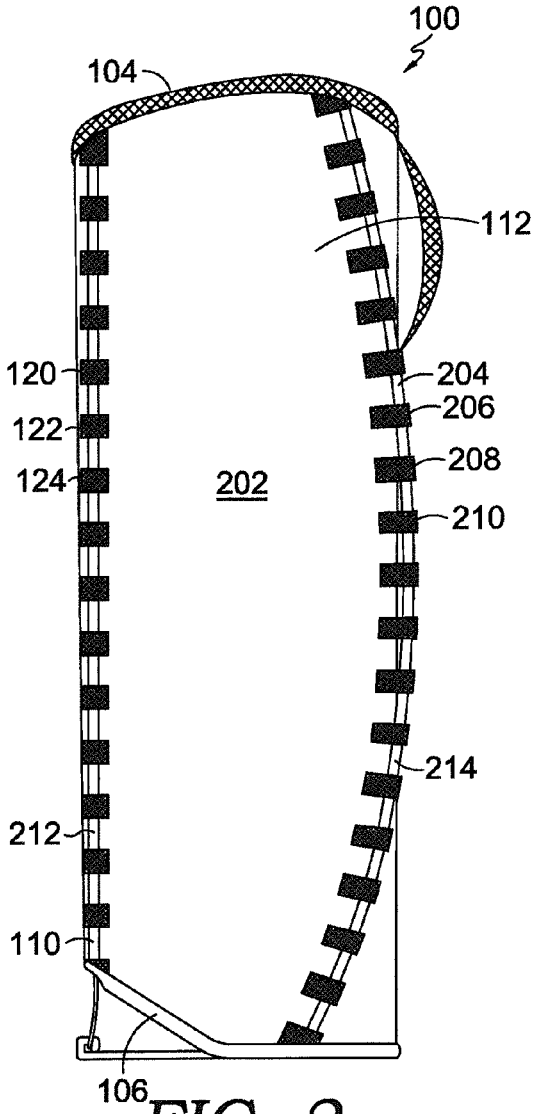
FIG. 2 is a side perspective view of the modular golf bag of FIG. 1.

FIG. 2 illustrates side 202 of modular golf bag 100 of FIG. 1. Pole 110, frame top 104, frame bottom 106, as well as pole sleeves 120, 122, and 124 shown in FIG. 1 are also visible in FIG. 2. A third pole 204 extends from frame top 104 to frame bottom 106. As with poles 108 and 110 shown in FIG. 1, pole 204 runs through a number of pole sleeves spaced along the length of pole 204, including pole sleeves 206, 208, and 210.

Although only three poles are visible in the perspectives illustrated in FIGS. 1 and 2, bag 100 comprises four poles. In some examples, a modular golf bag in accordance with the present invention includes two poles, three poles, four poles, or more than four poles. Poles 108 and 110 in FIG. 1 are substantially straight. Pole 204 in FIG. 2 is curved from frame top 104 to frame bottom 106. It is contemplated that the plurality of poles in various examples of modular golf bags in accordance with the present invention may have a variety of pole placement configurations as well as number of poles, including poles that cross over each other or extend diagonally from frame top to frame bottom.

The use of poles 108, 110, 204, and the fourth pole (not shown) running through pole sleeves provides a lightweight external frame for modular golf bag 100. An "external frame" has structural support substantially on the exterior of the bag body. In FIGS. 1 and 2, poles 108, 110, 204, and the fourth pole (not shown) substantially form the side boundaries of bag 100, and pliable bag body 112 extends from frame top 104 to frame bottom 106 internal to the side boundaries. By "internal," it is meant that pliable bag body 112 is substantially inside the area bounded by poles 108, 110, 204, and the fourth pole.

Poles 108, 110, and 204, provide structure to pliable bag body 112 by securing pliable bag body 112 to poles 108, 110, and 204 in an extended position. That is, the external frame provided by poles 108, 110, and 204 holds pliable bag body 112 in an "open" or "full" position as if pliable bag body 112 were inflated or full of a liquid. Bag 100 is designed such that when poles 108, 110, and 204 are run through the pole sleeves, pliable bag body 112 is substantially taut with each panel included in bag body 112 being extended between two or more poles. Because pliable bag body 112 is pliable, bag body 112 would not remain open and extended without the pole sleeves. In FIGS. 1 and 2, a plurality of portions of each pole are exposed and accessible. Exposed pole portions such as exposed portions 212 and 214, can be used as attachment points for additional storage compartments, as will be discussed with reference to FIGS. 7-10.

Figure 3:
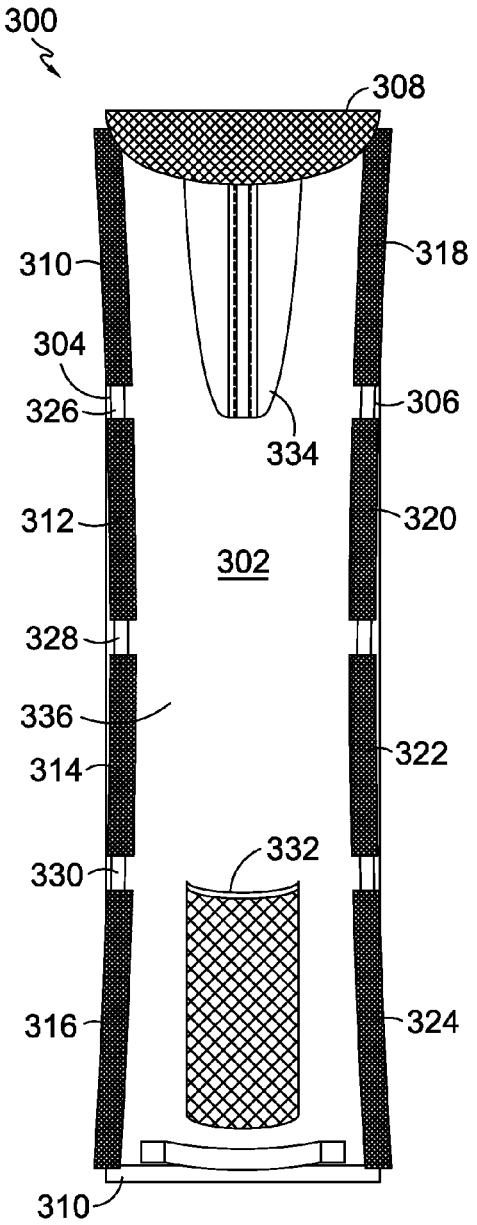
FIG. 3 is a front perspective view of a modular golf bag in accordance with an example of the present invention, the golf bag having a small number of external pole sleeves spaced along the length of each pole.
Figure 4:
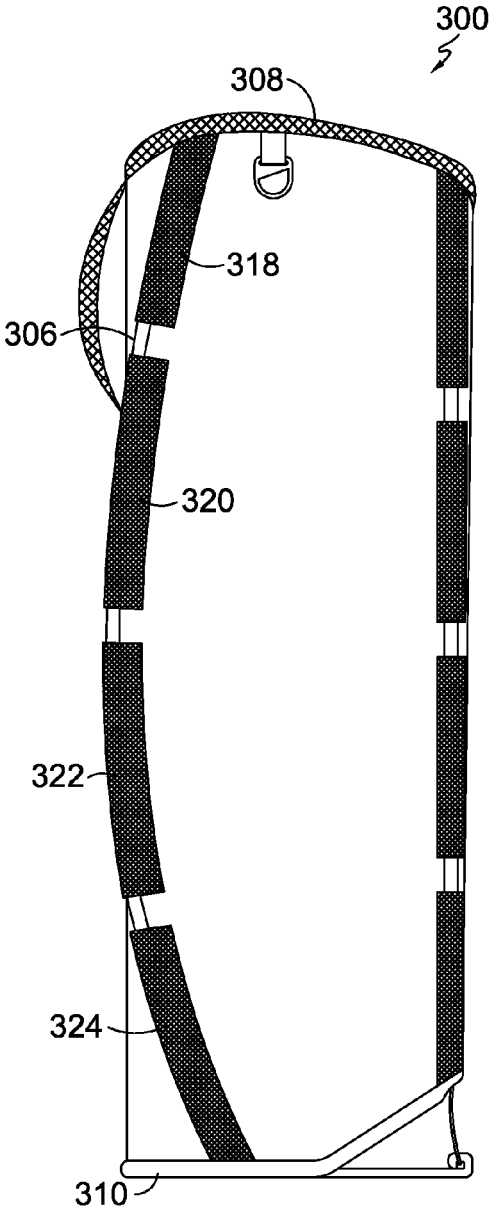
FIG. 4 is a side perspective view of the modular golf bag of FIG. 3.

Various configurations and types of pole sleeves are contemplated. FIGS. 3 and 4 illustrate modular golf bag 300, which has larger pole sleeves than those illustrated in FIGS. 1 and 2. Front 302 of bag 300 is shown in FIG. 3. Poles 304 and 306 extend from frame top 308 to frame bottom 310. Rather than the small pole sleeves illustrated in FIGS. 1 and 2, bag 300 has four larger pole sleeves spaced along the length of each pole, pole sleeves 310, 312, 314, and 316 spaced along the length of pole 304 and pole sleeves 318, 320, 322, and 324 spaced along the length of pole 306. In one example, pole sleeves 310, 312, 314, and 316 may be a single pole sleeve running substantially the length of pole 304 with apertures cut in the pole sleeve such that pole portions 326, 328, and 330 are exposed and accessible. An example of this type is shown and discussed in FIGS. 7-9.

In FIG. 3, modular golf bag 300 includes a water bottle compartment 332 and a grab handle 334 attached to pliable bag body 336. In some examples, no additional storage compartments are permanently attached to the pliable bag body. In other examples, one or more commonly desired additional storage compartments, such as water bottle compartment 332, are permanently attached. FIG. 4 illustrates a side perspective view of modular golf bag 300. Modular additional storage compartments may be detachably connected to examples of modular golf bags in accordance with the present invention, as illustrated in FIGS. 7-10.

Figure 5:
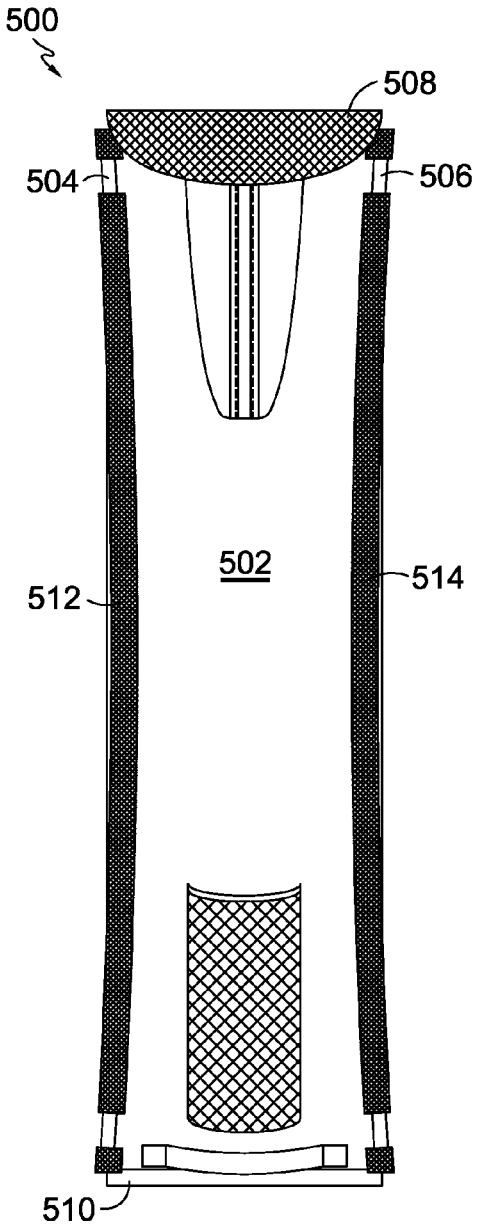
FIG. 5 is a front perspective view of a modular golf bag in accordance with an example of the present invention, the golf bag having a single external pole sleeve for each pole.
Figure 6:
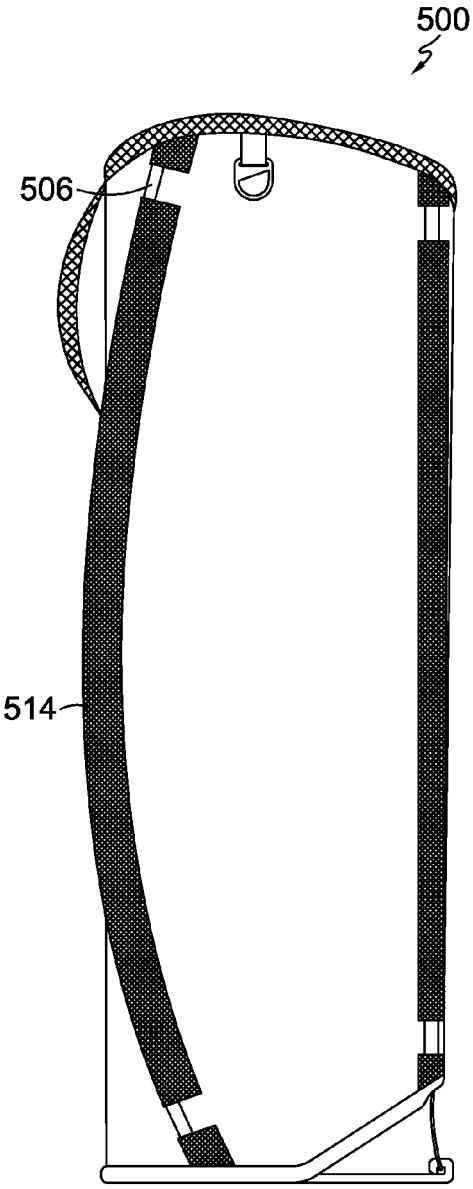
FIG. 6 is a side perspective view of the modular golf bag of FIG. 5.

FIG. 5 illustrates front 502 of modular golf bag 500. Poles 504 and 506 extend between frame top 508 and frame bottom 510. Pole 504 runs through pole sleeve 512, and pole 506 runs through pole sleeve 514. Pole sleeves 512 and 514 are substantially as long as poles 504 and 506. In some examples, the length of pole sleeves 512 and 514 is more than half the length of the corresponding pole. FIG. 6 illustrates a side perspective view of modular golf bag 500.

Figure 7:
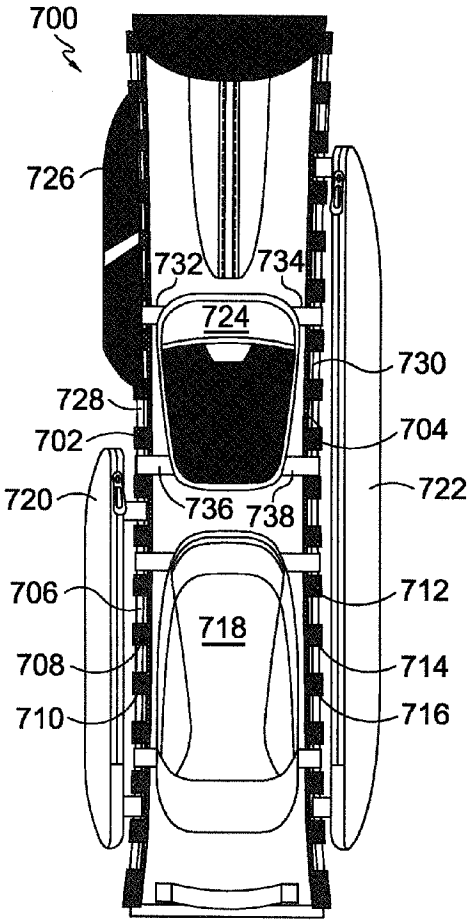
FIG. 7 is a front perspective view of a modular golf bag in accordance with an example of the present invention, the golf bag having external pole sleeves with a plurality of apertures spaced along the length of each pole sleeve and a plurality of additional storage compartments.

FIG. 7 illustrates modular golf bag 700 having pole sleeves 702 and 704. Pole sleeves 702 and 704 have a plurality of apertures 706, 708, 710, 712, 714, and 716 spaced along the length of each pole sleeve. It is to be appreciated that while FIG. 7 shows apertures spaced along substantially the entire length of pole sleeves 702 and 704, only three exemplary apertures along each pole sleeve are numbered for clarity. As discussed above, in some examples pole sleeves 702 and 704 are divided into individual pole sleeves with no pole sleeves where the apertures are located.

Modular golf bag 700 also includes additional storage compartments 718, 720, 722, and 724 as well as back pad 726. Each of additional storage compartments 718, 720, 722, and 724 and back pad 726 is detachably connected between two poles. Additional storage compartments 718 and 724 are detachably connected between poles 728 and 730. The second pole to which additional storage compartments 720 and 722 and back pad 726 are detachably connected are shown in FIGS. 8 and 9.

Figure 9:
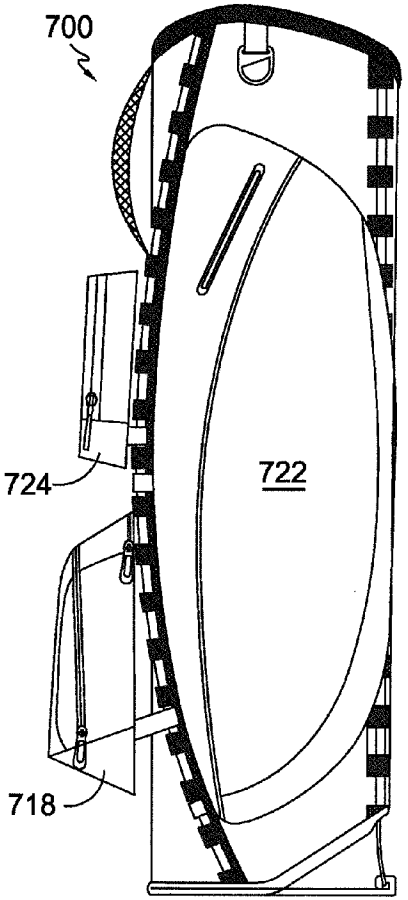
FIG. 9 is a side perspective view of the modular golf bag of FIGS. 7 and 8.
Figure 8:
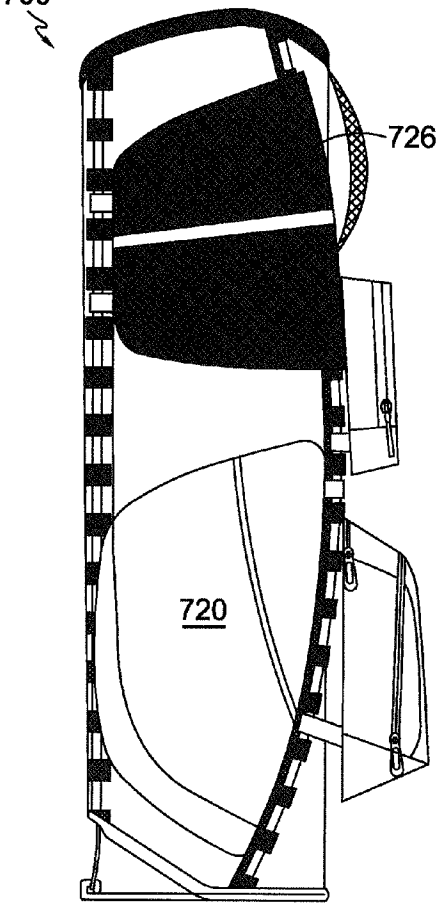
FIG. 8 is a side perspective view of the modular golf bag of FIG. 7.

FIGS. 7-9 illustrate additional storage compartments 718, 720, 722, and 724, as well as back pad 726, connected on exposed portions of the corresponding poles. Detachably connected additional storage compartments allow a golfer to select specific compartments to use with her bag. A golfer can add or remove compartments to react to changing circumstances to minimize weight and maximize functionality. Additionally, a golfer may select multiple compartments of a same type, reverse a typical accessory compartment layout to reflect that the golfer is left-handed or likes to position her bag in a certain way, or make other personalized modifications.

A detachable connection can be accomplished in a variety of ways, including each compartment having a plurality of straps with a buckle-type closure or having a connector to enable a compression fit, such as a hook or "c-shaped" piece. In FIG. 7, for example, additional storage compartment 724 is shown with straps 732, 734, 736, and 738 extending to and wrapping around poles 728 and 730 on exposed and accessible pole portions.

The exposed and accessible pole portions allow a strap to be wrapped completely around the exposed pole portion. In examples such as bag 500 of FIGS. 5 and 6 that have substantially pole-length pole sleeves, a compression fit may be more appropriate. In some examples, however, the pliable bag body itself may have slits to accommodate strapping an additional storage compartment around both a pole and corresponding pole sleeve even when a pole portion is not exposed and accessible. In such cases, connectors are in direct contact with the pole sleeve rather than exposed portions of the pole. Alternatively, a pole sleeve may not be attached to the pliable bag body along the entire length of the pole sleeve, leaving spaces for straps to wrap around both the pole and pole sleeve. Other connection mechanisms, such as grommets embedded in the pole sleeves, are also contemplated.

FIGS. 8 and 9 illustrate side views of modular golf bag 700. Although FIGS. 7-9 show each additional storage compartment detachably connected between only two poles, additional storage compartments may be detachably connected among three or more poles as well. Additional storage compartments are detachably connectable in a plurality of locations between at least two poles. For example, additional storage compartment 724 is shown detachably connected near the middle of bag 700, but compartment 724 may also be connected to a variety of other attachment points. In one specific example, additional storage compartments 718 and 724 could be interchanged.

The modular nature of golf bag 700 allows a plurality of different additional storage compartments to be detachably connected between the same attachment points, and, depending on the placement of the poles, allows a particular additional storage compartment to be detachably connectable both between attachment points of a first plurality of poles as well as between attachment points of a second plurality of poles, the first plurality being different from the second plurality. "Attachment points" refer to any potential place where an additional storage compartment can be connected. Thus, attachment points will vary depending on the design of the modular golf bag. In FIGS. 7-9, each exposed pole portion is an attachment point. If a compression fit with a c-shaped connector were used, each pole would be essentially one large connection point.

Figure 10:
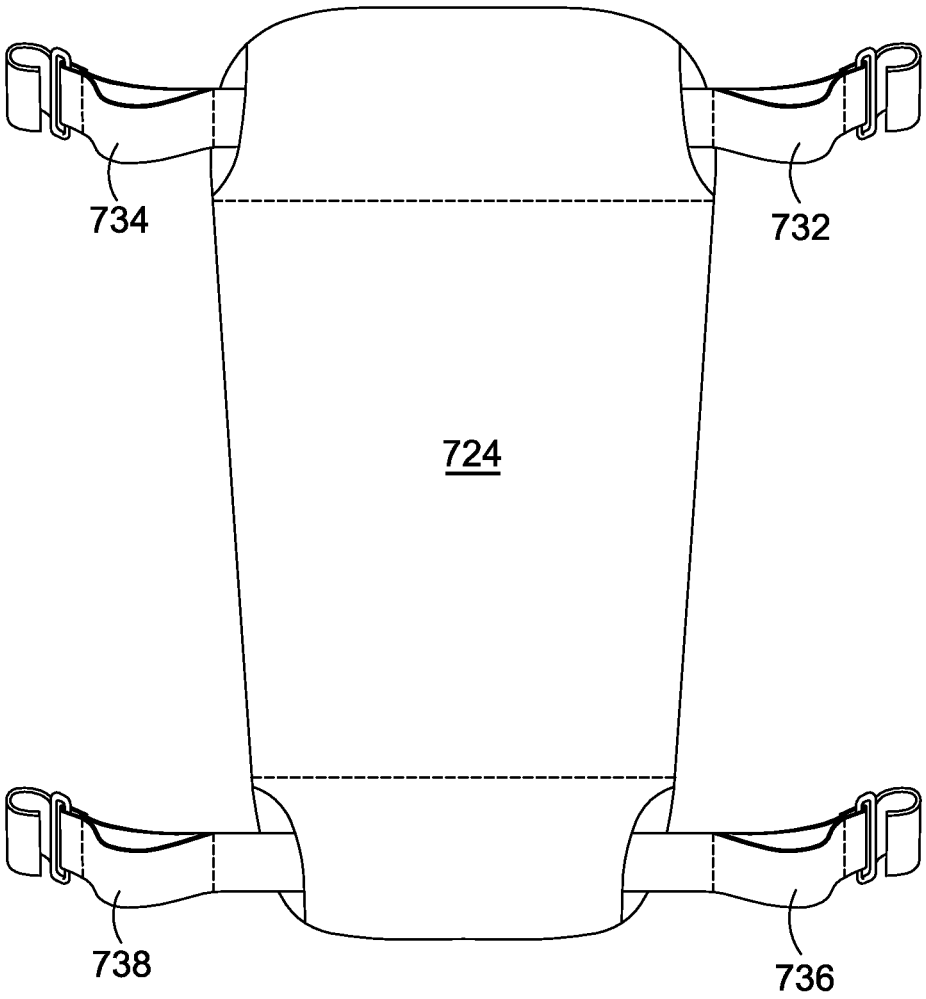
FIG. 10 is a back perspective view of additional storage compartment shown in FIGS. 7-9.

A back view of additional storage compartment 724 is shown in FIG. 10. Straps 732, 734, 736, and 738 extend from additional storage compartment 724 and are wrapped around exposed pole portions. FIG. 10 is exemplary; a variety of connection mechanisms are contemplated.

The various types of pole sleeves illustrated in FIGS. 1-9 may be attached to the pliable bag body in a variety of ways. In some examples, the pole sleeves may be sewn to the pliable bag body. Additionally, while the pole sleeves are shown as substantially evenly spaced, the sleeves may be spaced at any intervals or location desired. Poles may be made of fiberglass, aluminum, titanium, or other lightweight, sturdy materials. Pliable bag bodies may be made of nylon or other lightweight, strong materials, both natural and synthetic.

While FIGS. 1-9 show golf bags with external poles, alternative embodiments depicted in FIGS. 11-16 illustrate golf bags with internal poles. Other embodiments may use a combination of internal and external poles or pole sleeves. For example, a golf bag may keep poles on the side of a bag opposite a shoulder strap inside a pliable bag body and keep poles on the shoulder-strap side on the outside.

In addition to pole sleeves, different embodiments may additionally or alternatively include slits in the pliable bag body. As discussed herein, a slit is an opening or aperture in a golf bag's pliable bag body. While pole sleeves hold a pole inside or outside of the pliable bag body, slits may provide areas for poles to enter or exit the pliable bag body or simply provide openings that expose the poles. In one embodiment, a slit exposes a portion of a pole positioned inside of a pliable bag body, making the pole accessible for attaching clip-on accessories (e.g., golf towel, gloves, keys, flags, etc.), pockets, or other separable compartments. Slits may be reinforced in any number of ways to prevent bag tearing. For instance, cloth, leather, vinyl, polyurethane, metal, plastic, or other support material may be stitched, glued, heat-pressed, or otherwise affixed around slit openings. Embodiments that use slits instead of pole sleeves make manufacturing easier because slits only need to be cut out of bag bodies while pole sleeves need to be created separately and attached.

FIGS. 11-18 illustrate different embodiments that have both slits and pole sleeves, but the present invention does not require both. In fact, some embodiment may include only slits, only pole sleeves, or some different combination of slits and pole sleeves than the embodiments shown in FIGS. 11-18.

Figure 11:
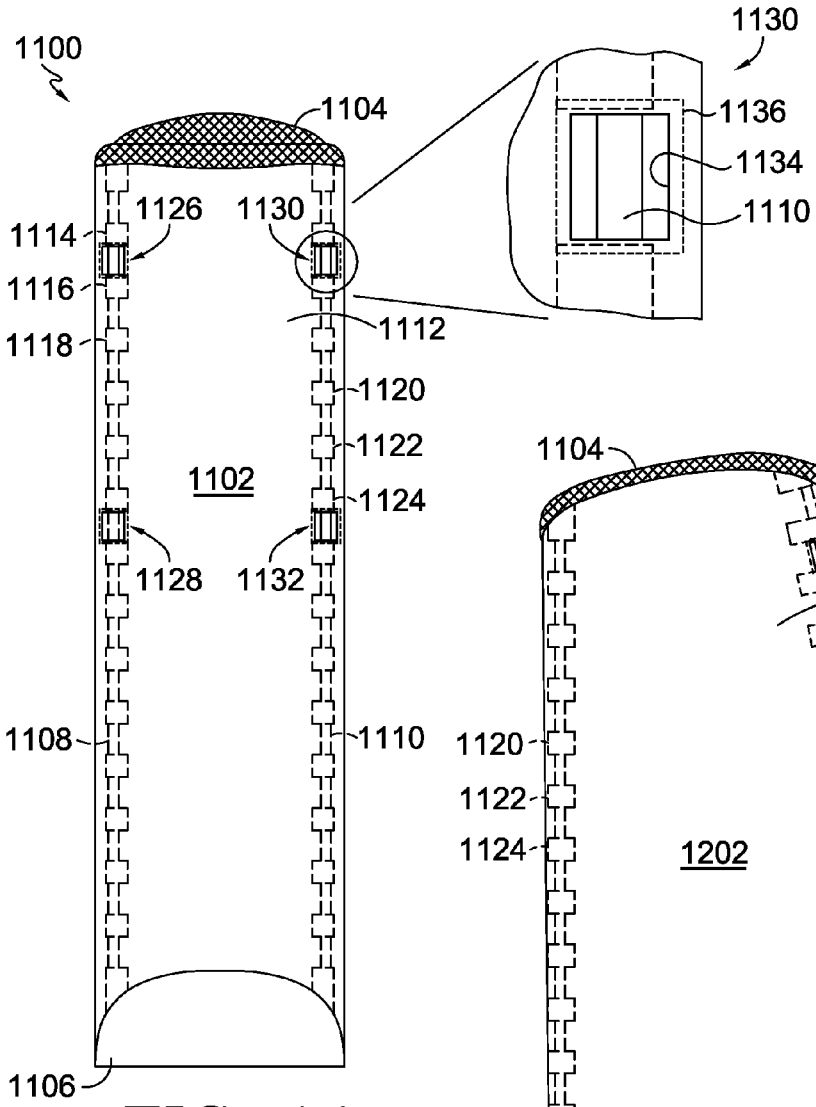
FIG. 11 is a back perspective view of a modular golf bag in accordance with an example of the present invention, the golf bag having a large number of internal pole sleeves spaced along the length of each pole.

FIG. 11 depicts a front side 1102 of modular golf bag 1100. Frame top 1104 is capable of receiving golf clubs. In some examples frame top 1104 is open. In other examples, frame top 1104 includes a rim and zippered covering. Frame bottom 1106 is located approximately the length of a golf club below frame top 1104. A plurality of poles 1108 and 1110 connect frame top 1104 and frame bottom 1106. The dotted lines of poles 1108 and 1110 indicate that pliable bag body 1112 is external to poles 1108 and 1110 Pliable bag body 1112 extends between frame top 1104 and frame bottom 1106 such that a cavity (not shown) capable of receiving golf clubs through frame top 1104 is formed.

The dotted lines referencing pole sleeves 1114, 1116, 1118, 1120, 1122, and 1124 indicate the illustrated pole sleeves are attached to the inside of pliable bag body 1112. So the shown embodiment includes both poles and pole sleeves on the inside of pliable bag body 1112. Inside pliable bag body 1112, poles 1108 and 1110 are held within poles sleeves 1114, 1116, 1118, 1120, 1122, and 1124. Each of pole sleeves 1114, 1116, and 1118 surround at least a portion of the length of pole 1108. Similarly, each of pole sleeves 1120, 1122, and 1124 surround at least a portion of the length of pole 1110. Each of poles 1108 and 1110 runs through at least one pole sleeve. Pole sleeves 1114, 1116, 1118, 1120, 1122, and 1124 provide structure to pliable bag body 1112 by internally securing pliable bag body 1112 to poles 1108 and 1110. Only pole sleeves 1114, 1116, 1118, 1120, 1122, and 1124 are numbered in FIG. 11 for clarity, but it is to be appreciated that FIG. 11 illustrates pole sleeves spaced across substantially the entire length of poles 1108 and 1110.

In addition to internal sleeves, modular bag 1100 also includes slits 1126, 1128, 1130, and 1132. Slits are openings or apertures in pliable bag body. As shown in the enlarged portion of FIG. 11, the slits, such as slit 1130, have a surrounding edge 1134 that may have a corresponding reinforcement 1136.

Figure 12:
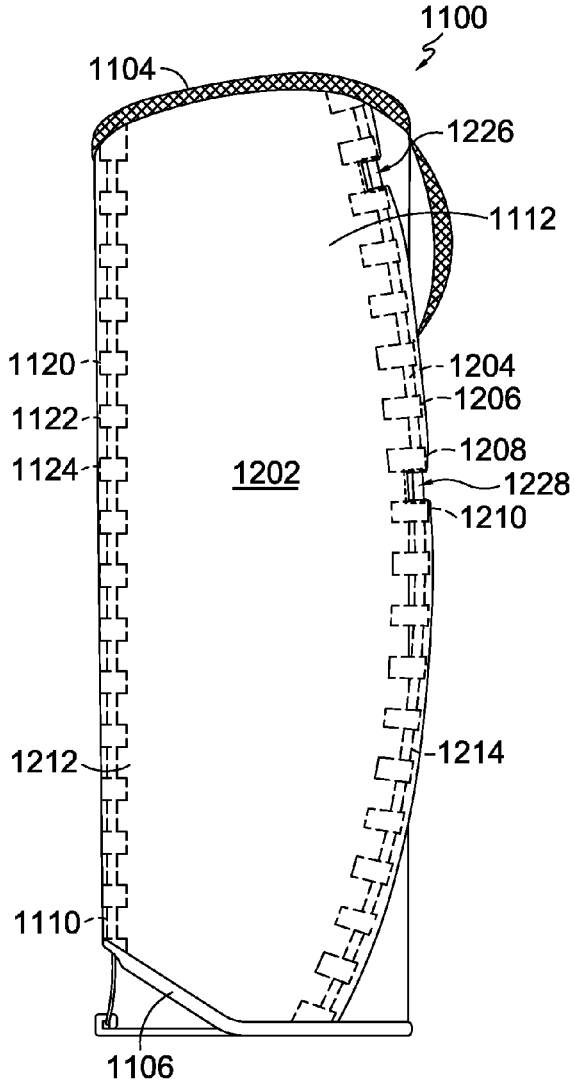
FIG. 12 is a side perspective view of the modular golf bag of FIG. 11.

FIG. 12 illustrates side 1202 of modular golf bag 1100 of FIG. 11. Pole 1204, frame top 1104, frame bottom 1106, as well as pole sleeves 1120, 1122, and 1124 shown in FIG. 11 are also visible in FIG. 12. A third pole 1204 extends from frame top 1104 to frame bottom 1106 and is oriented inside of bag 1100. As with poles 1108 and 1110 shown in FIG. 11, pole 1204 runs through a number of pole sleeves internally attached to pliable bag body 1112, spanning the length of pole 1204 and including pole sleeves 1206, 1208, and 1210 that are also internally attached. Additionally, pole 1204 traverses slits 1126 and 1228, which expose pole 1204.

Although only three poles are visible in the perspectives illustrated in FIGS. 11 and 12, bag 1100 may include additional or fewer poles—for instance, 2, 4, 5, 6, or more. Poles 1108 and 1110 in FIG. 11 are substantially straight. Pole 1204 in FIG. 12 is curved from frame top 1104 to frame bottom 1106. It is contemplated that the plurality of poles in various examples of modular golf bags in accordance with the present invention may have a variety of pole placement configurations as well as number of poles, including poles that cross over each other or extend diagonally from frame top to frame bottom. Embodiments may include such poles and pole configurations inside or outside of pliable bag body 1112.

The use of poles 1108, 1110, 1204, and the fourth pole (not shown) running through pole sleeves provides a lightweight internal frame for modular golf bag 1100. An "internal frame" has structural support substantially on the internal side of the bag body. In FIGS. 11 and 12, poles 1108, 1110, 1204, and the fourth pole (not shown) substantially form the side boundaries of bag 1100. Also, pliable bag body 1112 extends from frame top 1104 to frame bottom 1106 outside the area bounded by poles 1108, 1110, 1204, and the fourth pole.

Internally securing pliable bag body 1112 to poles 1108, 1110, and 1204 provides structure to golf bag 1100 without exposing poles 1108, 1110, and 1204. That is, the internal frame provided by poles 1108, 1110, and 1204 holds pliable bag body 1112 in an "open" or "full" position as if pliable bag body 1112 were inflated or full of a liquid. Bag 1100 is designed such that when poles 1108, 1110, and 1204 are run through pole sleeves internally attached to pliable bag body 1112, pliable bag body 1112 is tautly pulled with each panel included in bag body 1112 being extended between two or more poles. Because pliable bag body 1112 is pliable, bag body 1112 would not remain open and extended without the pole sleeves. As indicated with various dotted lines, the poles and pole sleeves of FIGS. 11 and 12 are all internally located within pliable bag body 1112. So while some embodiments of the invention will include externally positioned poles and pole sleeves, alternative embodiments will place pole and pole sleeves internally within a golf bag body.

Figure 13:
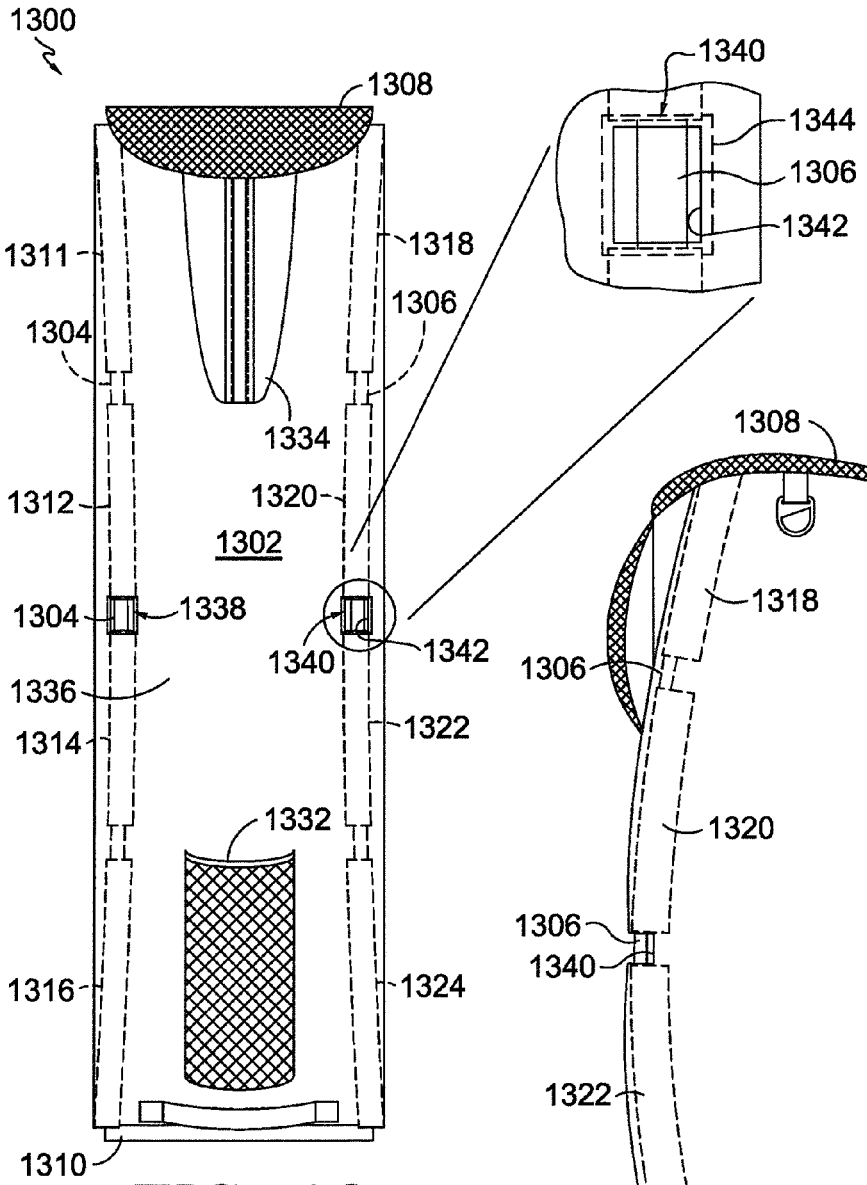
FIG. 13 is a front perspective view of a modular golf bag in accordance with an example of the present invention, the golf bag having a small number of internal pole sleeves spaced along the length of each pole.

Somewhat similarly to FIG. 11, FIG. 13 depicts a front side 1302 of modular golf bag 1300. Frame top 1308 is capable of receiving golf clubs. In some examples frame top 1308 is open. In other examples, frame top 1308 includes a rim and zippered covering. Frame bottom 1310 is located approximately the length of a golf club below frame top 1308. A plurality of poles 1304 and 1306 connect frame top 1308 and frame bottom 1310. The dotted lines of poles 1304 and 1306 indicate that pliable bag body 1336 is external to poles 1304 and 1306. Pliable bag body 1336 extends between frame top 1308 and frame bottom 1310 such that a cavity (not shown) capable of receiving golf clubs through frame top 1308 is formed.

The dotted lines referencing pole sleeves 1311, 1312, 1314, 1316, 1318, 1320, 1322 and 1324 indicate the illustrated pole sleeves that are attached to the inside of pliable bag body 1336. So the shown embodiment includes both poles and pole sleeves on the inside of pliable bag body 1336. Inside pliable bag body 1336, poles 1304 and 1306 are held within poles sleeves 1311, 1312, 1314, 1316, 1318, 1320, 1322 and 1324. Each of pole sleeves 1311, 1312, 1314, and 1316 surround at least a portion of the length of pole 1304. Similarly, each of pole sleeves 1318, 1320, 1322 and 1324 surround at least a portion of the length of pole 1306. Each of poles 1304 and 1306 runs through at least one pole sleeve. Pole sleeves 1311, 1312, 1314, 1316, 1318, 1320, 1322 and 1324 provide structure to pliable bag body 1336 by internally securing pliable bag body 1336 to poles 1304 and 1306.

In addition to internal sleeves, modular bag 1300 also includes slits 1338 and 1340. Slits are openings or apertures in pliable bag body. As shown in the enlarged portion of FIG. 13, the slits, such as slit 1340 have a surrounding edge 1342 that may have a corresponding reinforcement 1344.

In FIG. 13, modular golf bag 1300 includes a water bottle compartment 1332 and a grab handle 1334 attached to pliable bag body 1336. In some examples, no additional storage compartments are permanently attached to the pliable bag body. In other examples, one or more commonly desired additional storage compartments, such as water bottle compartment 1332, are permanently attached. Also shown in FIG. 13 is an embodiment where elongated pole sleeves 1314 and 1322 hold poles 1304 and 1306 inside pliable bag body 1336. Dotted lines illustrating elongated pole sleeves 1314 and 1322 and poles 1304 and 1306 indicate each is positioned inside pliable bag body 1336. Different embodiments of the invention will use pole sleeves of various lengths.

Figure 14:
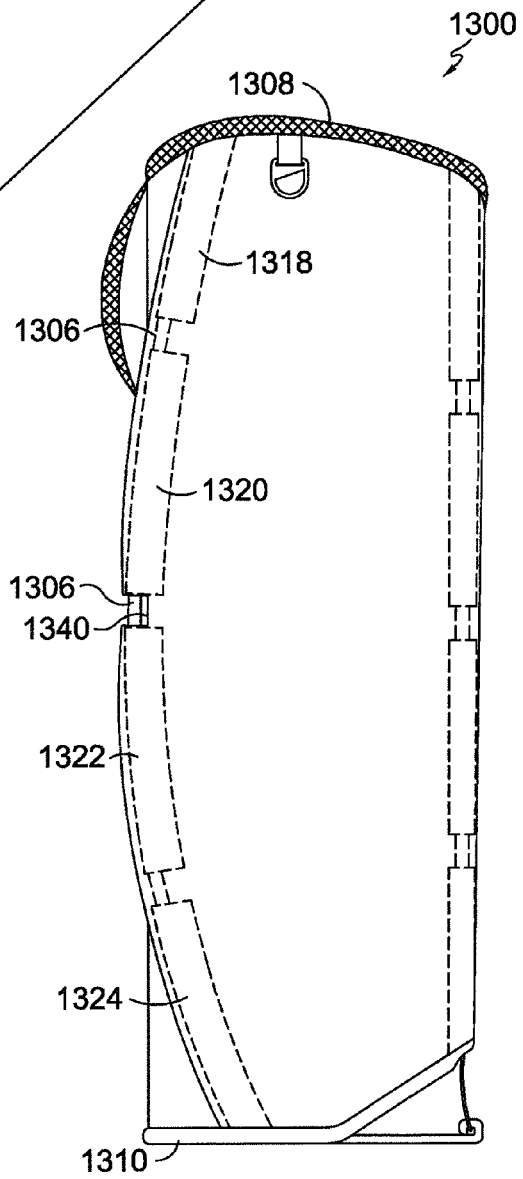
FIG. 14 is a side perspective view of the modular golf bag of FIG. 13.

FIG. 14 illustrates a side perspective view of modular golf bag 1300. Modular additional storage compartments may be detachably connected in various ways, such as by stitches, hook-and-loop fasteners, snaps, buttons, adhesives, magnets, or the like. In one embodiment, storage compartments may have arms with one or more rings or loops that can be held in place by inserting an internal pole exposed at a slit or other opening of pliable bag body 1336. Various other ways may be used to attach additional storage compartments, such as compartment 1850 shown in FIG. 18.

Figure 15:
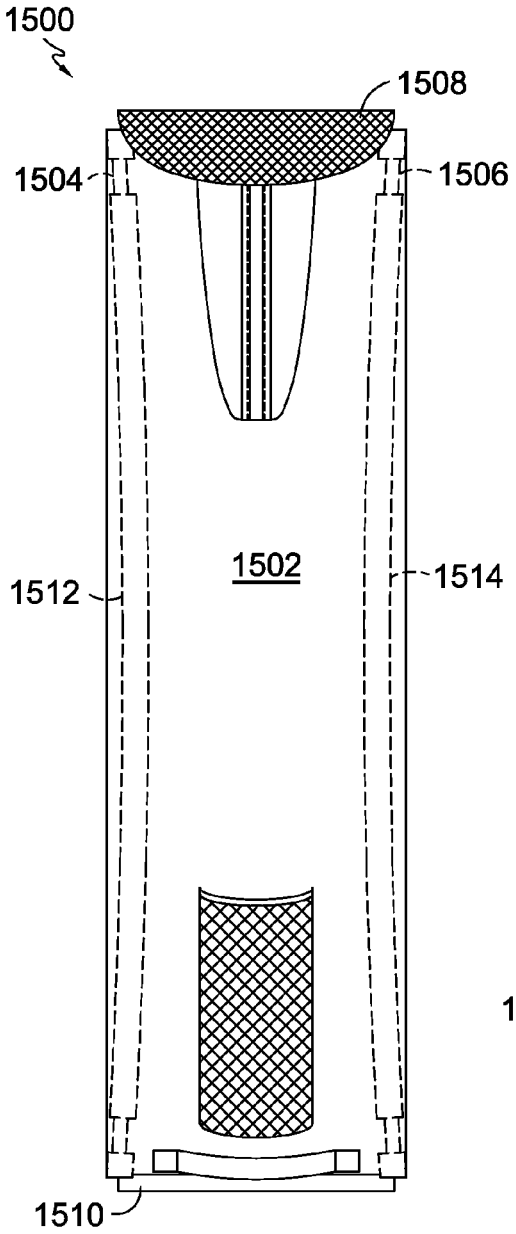
FIG. 15 is a front perspective view of a modular golf bag in accordance with an example of the present invention, the golf bag having a single internal pole sleeve for each pole.
Figure 16:
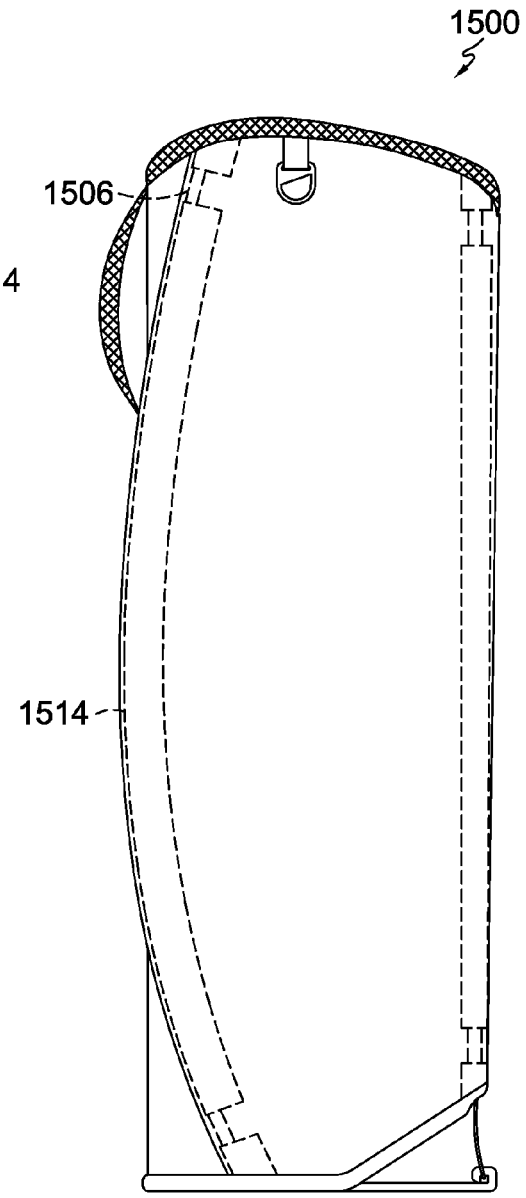
FIG. 16 is a side perspective view of the modular golf bag of FIG. 15.

FIG. 15 illustrates front 1502 of modular golf bag 1500 with even longer internal sleeves 1512 and 1514 for poles 1504 and 1506 that are attached on the inside of modular golf bag 1500. Poles 1504 and 1506 extend between frame top 1508 and frame bottom 1510. Pole 1504 runs through pole sleeve 1512, and pole 1506 runs through pole sleeve 1514. Pole sleeves 1512 and 1514 are substantially as long as poles 1504 and 1506. In some examples, the length of pole sleeves 1512 and 1514 is more than half the length of the corresponding pole. FIG. 16 illustrates a side perspective view of modular golf bag 1500.

Instead of using pole sleeves, poles may enter or exit a pliable bag body through slits in the body itself. Edges of the slits may be reinforced to provide additional durability in numerous ways. For example, slit edges may be laminated; heat-staked; over-molded with a rubber, polymer, plastic, ceramic, or the like; stitched over; or reinforced in another similar fashion. Embodiments using slits may permit poles passing into and out of a pliable bag body at different places. Such openings may be ideal locations for hanging loops, rings, or other connectors of detachable compartments.

Figure 17:
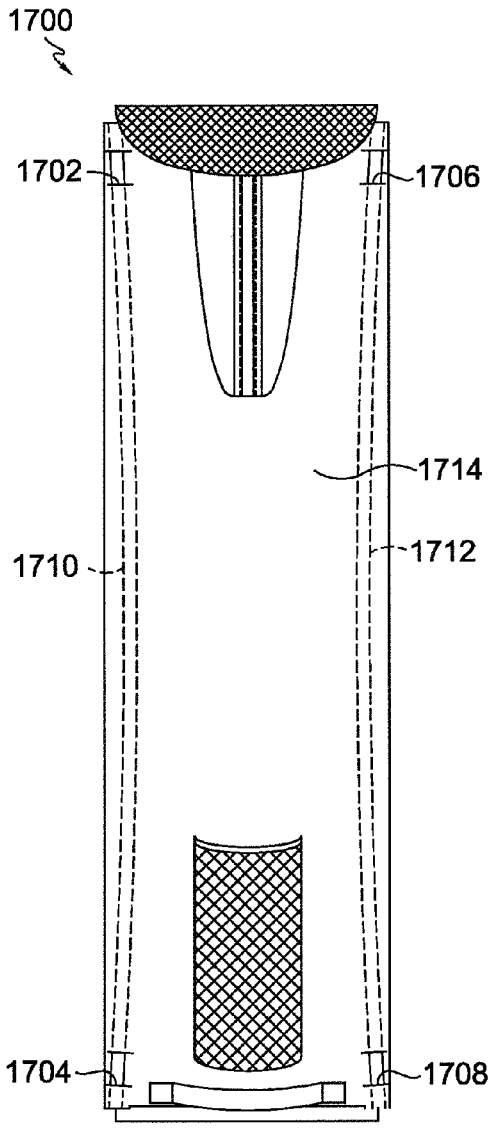
FIG. 17 is a front perspective view of a modular golf bag in accordance with an example of the present invention, the golf bag having slits for poles that internally support a pliable body of the golf bag.

FIG. 17 illustrates a front side of modular golf bag 1700 that has different slits 1702, 1704, 1706, and 1708 for poles 1710 and 1712. The depicted embodiment shows pole 1710 entering into pliable bag body 1714 at top slit 1702 and exiting pliable bag body 1714 at bottom slit 1704. Similarly, pole 1712 enters pliable bag body 1714 at top slit 1706 and exiting pliable bag body 1714 at bottom slit 1708. In embodiments where poles are mostly external to a golf bag, alternative embodiments may have poles exit from slits 1702 and 1706 and enter through slits 1704 and 1708, allowing the poles to be externally held in place by various slits. Some embodiments may include additional or fewer slits or may position slits in different places of the modular golf bag—such as in the middle.

Figure 18:
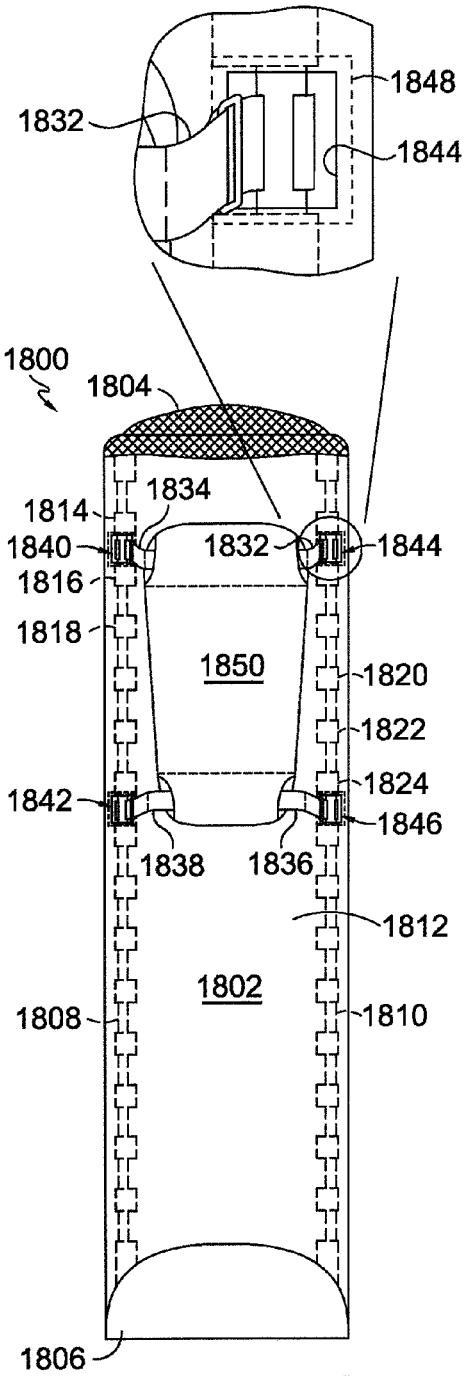
FIG. 18 is a back perspective view of a modular golf bag, similar to FIG. 11, but shown with an additional storage compartment.

FIG. 18 depicts a front side 1802 of modular golf bag 1800. Frame top 1804 is capable of receiving golf clubs. In some examples frame top 1804 is open. In other examples, frame top 1804 includes a rim and zippered covering. Frame bottom 1806 is located approximately the length of a golf club below frame top 1804. A plurality of poles 1808 and 1810 connect frame top 1804 and frame bottom 1806. The dotted lines of poles 1808 and 1810 indicate that pliable bag body 1812 is external to poles 1808 and 1810. Pliable bag body 1812 extends between frame top 1804 and frame bottom 1806 such that a cavity (not shown) capable of receiving golf clubs through frame top 1804, is formed.

The dotted lines referencing pole sleeves 1814, 1816, 1818, 1820, 1822, and 1824 indicate the illustrated pole sleeves are attached to the inside of pliable bag body 1812. So the shown embodiment includes both poles and pole sleeves on the inside of pliable bag body 1812. Inside pliable bag body 1812, poles 1808 and 1810 are held within pole sleeves 1814, 1816, 1818, 1820, 1822, and 1824. Each of pole sleeves 1814, 1816, and 1818 surround at least a portion of the length of pole 1808. Similarly, each of pole sleeves 1820, 1822, and 1824 surround at least a portion of the length of pole 1810. Each of poles 1808 and 1810 runs through at least one pole sleeve. Pole sleeves 1814, 1816, 1818, 1820, 1822, and 1824 provide structure to pliable bag body 1812 by internally securing pliable bag body 1812 to poles 1808 and 1810. Only pole sleeves 1814, 1816, 1818, 1820, 1822, and 1824 are numbered in FIG. 18 for clarity, but it is to be appreciated that FIG. 18 illustrates pole sleeves spaced across substantially the entire length of poles 1808 and 1810.

In addition to internal sleeves, modular bag 1800 also includes slits 1840, 1842, 1844, and 1846. Slits are openings or apertures in pliable bag body 1812. These slits expose a portion of poles 1808 and 1810. Additionally, slits 1840-1846 may be used to attach an additional storage compartment, such as compartment 1850. As shown, compartment 1850 may have straps 1832, 1834, 1836 and 1838 that may be used to secure compartment 1850 to the expose portions of poles 1808 and 1810. Each slit 1840-1846 may be reinforced, as shown in an exemplary embodiment at 1848.

Figure 19:
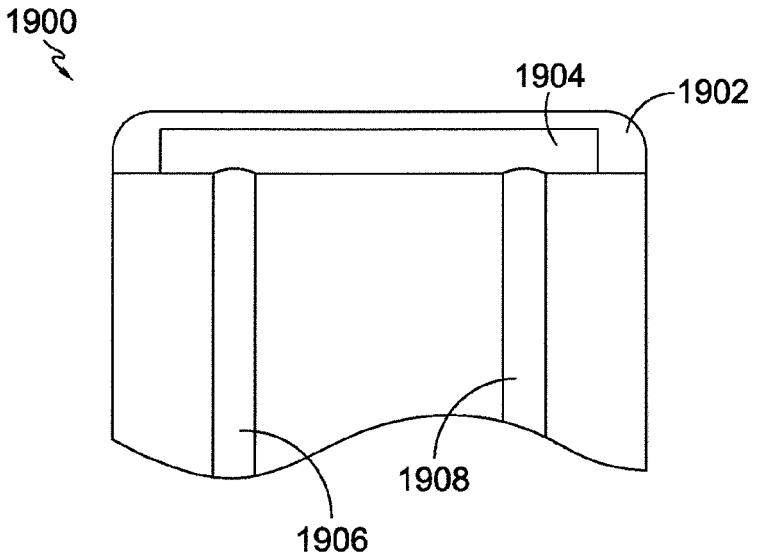
FIGS. 19 and 20 show bag poles connected to cross bars that provide structure and transversal support of a modular golf bag in accordance with an example of the present invention.
Figure 20:
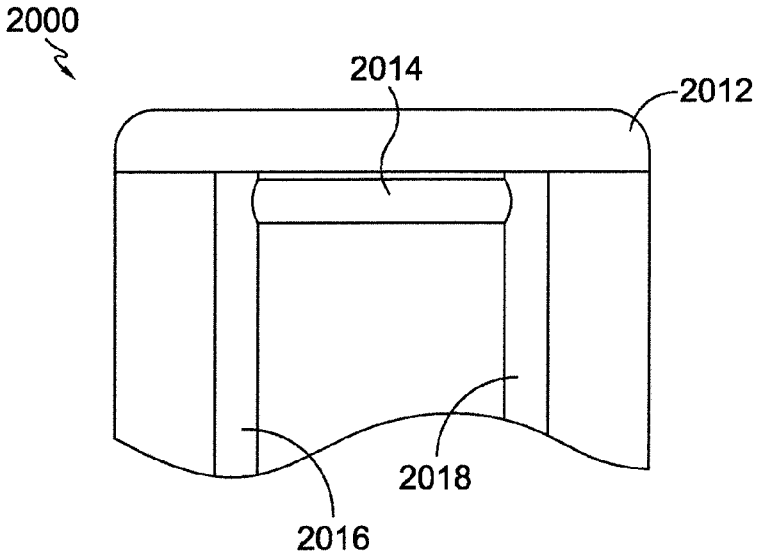

Poles may also be connected to cross bars for added support of the bag body. FIGS. 19 and 20 show bag poles connected to cross bars that provide structure and transversal support of a modular golf bag in accordance with an example of the present invention. Looking initially at FIG. 19, configuration 1900 shows the top of golf bag 1902 with cross bar 1904 being connected to poles 1906 and 1908. Poles 1906 and 1908 may be connected to cross bar 1904 in any number of ways, such as, for example, using a hinge, bolt, screw, ball and socket, dovetail, or any other way of attachment. FIG. 20 shows another configuration 2000 where cross bar 2014 connects to the sides of poles 2016 and 2018, using any of the above or other well-known ways of attachment. While FIGS. 19 and 20 seem to illustrate cross bars on the top of a golf bag, embodiments may position and attach cross bars anywhere along internal or external poles, such as at bottom, top, or anywhere in the middle.

As shown in FIGS. 2, 4, 6, 8, 12, 14, and 16, some bags may have poles that are bowed or somehow biased in the transverse direction when the back is upright, giving the back the look of bowing outwardly or, in some embodiments, inwardly. Placing poles that bow opposite the side of the bag with a shoulder strap may make it easier for the back to lean on a hinged bag stand that is released when the golfer puts the bag down. Bowing poles may also improve the aesthetics or provide additional material for displaying various indicia (e.g., logos, advertisements, etc.).

The present invention has been described in relation to particular examples, which are intended in all respects to be illustrative rather than restrictive. Alternative examples will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. A modular golf bag comprising:

a frame top capable of receiving golf clubs;

a frame bottom located approximately the length of a golf club below the frame top;

a plurality of poles connecting the frame top and the frame bottom;

a pliable bag body external to the plurality of poles extending between the frame top and the frame bottom such that a cavity capable of receiving golf clubs through the frame top is formed;

a plurality of pole sleeves attached internally to the pliable bag body and each surrounding at least a portion of the length of one of the plurality of poles such that each of the plurality of poles runs through at least one pole sleeve, the plurality of pole sleeves providing structure to the pliable bag body by internally securing the pliable bag body to the plurality of poles; and at least one additional storage compartment that is detachably connected between at least two of the plurality of poles on exposed portions of the corresponding poles.

2. The modular golf bag of claim 1, wherein a plurality of portions of each pole are internally exposed to the inside of the pliable bag body.

3. The modular golf bag of claim 1, wherein each of the plurality of poles runs through one pole sleeve, and wherein the length of each pole sleeve is more than half of the length of the corresponding pole.

4. The modular golf bag of claim 1, wherein each of the plurality of poles runs through a pole sleeve having a plurality of apertures spaced along the length of the pole sleeve through which portions of the pole are internally exposed inside the pliable bag and accessible.

5. The modular golf bag of claim 1, wherein the plurality of poles includes at least four poles.

6. The modular golf bag of claim 1, wherein the at least one additional storage compartment is connected between the at least two of the plurality of poles via one of a plurality of straps or a compression fit.

7. The modular golf bag of claim 1, wherein the at least one additional storage compartment includes at least two detachable connections operable to engage the exposed portions of the corresponding poles.

8. The modular golf bag of claim 1, wherein the at least one additional storage compartment is detachably connectable in a plurality of locations between the at least two of the plurality of poles.

9. A modular golf bag comprising: a frame top capable of receiving golf clubs; a frame bottom located approximately the length of a golf club below the frame top; at least three poles connecting the frame top and the frame bottom; a pliable bag body external to the at least three poles extending between the frame top and the frame bottom such that a cavity capable of receiving golf clubs through the frame top is formed; a plurality of pole sleeves attached to the inside of the pliable bag body and each of the pole sleeves surrounding at least a portion of the length of one of the at least three poles such that each of the poles runs through at least one pole sleeve, the plurality of pole sleeves providing structure to the pliable bag body by internally securing the pliable bag body to the at least three poles; and at least one additional storage compartment detachably connected between at least two of the at least three poles at one or more slits in the pliable bag body.

10. The modular golf bag of claim 9, wherein each of the at least three poles runs through at least two of the plurality of pole sleeves spaced along the length of the pole such that a plurality of portions of the pole are exposed inside the pliable bag body.

11. The modular golf bag of claim 10, wherein the at least one additional storage compartment is connected between the at least two poles on portions of the corresponding poles exposed by the one or more slits.

12. The modular golf bag of claim 10, wherein the at least one additional storage compartment is detachably connectable in a plurality of locations between the at least two poles.

13. The modular golf bag of claim 9, wherein each of the at least three poles runs through a pole sleeve having a plurality of apertures spaced along the length of the pole sleeve through which portions of the pole are internally exposed and accessible.

14. The modular golf bag of claim 13, wherein the at least one additional storage compartment is connected at locations between the at least two poles on portions of the corresponding poles exposed by the one or more slits.

15. The modular golf bag of claim 13, wherein a plurality of different additional storage compartments are detachably connected at the locations between the at least two poles.

* * * * *